United States Patent [19]

Kholin

[11] Patent Number: 4,501,257

[45] Date of Patent: Feb. 26, 1985

[54] ORIENTING ATTACHMENT TO BALL THROWING MACHINE

[75] Inventor: Boris G. Kholin, Sumy, U.S.S.R.

[73] Assignee: Sumskoi Filial Kharkovskogo Politekhnicheskogo Instituta, Sumy, U.S.S.R.

[21] Appl. No.: 398,377

[22] Filed: Jul. 14, 1982

[51] Int. Cl.[3] ..... F41D 11/00

[52] U.S. Cl. ..... 124/81; 273/26 D

[58] Field of Search ..... 124/81, 83, 84, 85, 124/34; 273/26 D

[56] References Cited

U.S. PATENT DOCUMENTS

| | | | |
|---|---|---|---|
| 3,102,526 | 9/1963 | Connor | 124/81 X |
| 3,288,127 | 11/1966 | Bullock | 124/81 X |
| 3,838,676 | 10/1974 | Kahelin | 124/81 X |
| 4,006,726 | 2/1977 | Sweeton et al. | 124/81 |

*Primary Examiner*—Richard J. Apley
*Assistant Examiner*—William R. Browne
*Attorney, Agent, or Firm*—Lilling & Greenspan

[57] ABSTRACT

An attachment to a ball throwing machine includes a stationary sleeve secured to the ball throwing machine barrel, a movable sleeve mounted for rotation onto the stationary sleeve, and a rotatable deflecting frame of two T-shaped levers with rollers, mounted on said movable sleeve. Rotation of the frame is restricted by stops, and at least one retainer is provided to lock the frame in one of the extreme positions, the retainer having the form of a flat spring connected to one of said levers and controlled by a cable through a helical compression spring.

5 Claims, 10 Drawing Figures

ORIENTING ATTACHMENT TO BALL THROWING MACHINE

BACKGROUND OF THE INVENTION

1. Field of the Invention

The present invention pertains to sporting ball throwing machines and is specifically concerned with orienting attachments to such machines, which provide for spinning the balls and projecting them in predetermined directions. Such attachments are usually installed at the ball outlet from a ball throwing machine: in a pneumatic ball throwing machine, at the end of its barrel, and in a mechanical one, on its housing in the ball flow path. The invention may be used to the best advantage in tennis or soccer ball throwing machines.

2. Description of the Prior Art

An important problem encountered by designers in developing ball spinning devices for ball throwing machines, in particular for tennis ones, is the provision of such an orienting attachment which would only insignificantly slow down the velocity of balls at the outlet from the ball throwing machine while not abrading them.

Despite the well-known attempts to solve the problem, it still remains to be solved adequately.

Thus, in practice, for spinning the balls, use is made of a simple device which is a strip of friction material, such as rubber, attached in the ball throwing machine to the inner surface of the barrel along the axis thereof in the ball outlet zone, whereas the remaining (i.e. free from the strip) inner surface of the barrel in the ball emergence zone has, on the contrary, an antifriction coating. The difference in the frictional forces acting upon diametrically opposite portions of the ball moving through the barrel gives rise to a torque which imparts to the ball the required spin in the flight.

This device suffers from the following disadvantages: an intense abrasive wear of balls because of their friction against the rubber strip and a low ball ejection velocity because of a loss of its energy resulting from friction against the same strip and the barrel of the ball throwing machine.

There is also known in the art an orienting attachment for a ball throwing machine, comprising a coupling unit to be secured to the machine and a ball deflector hinged to the unit (refer to the Specification ot the USSR Inventor's Certificate No. 490,476, Int. Cl$^3$. A 63B 69/40). In this attachment, the coupling unit is a hollow cylindrical body and the ball deflector has the form of a double-arm lever mounted on the body, one arm of the lever carrying a flat or channeled deflecting shelf, and the other arm being pressed against said body by a screw whereon a spring is placed. The degree of spinning of a ball ejected from the machine is controlled by varying the force of compression of said spring with the aid of the screw. In this attachment, the spinning degree is greater the longer the ball interacts with the deflecting shelf. For this reason, the deflecting shelf has a friction facing which lengthens the duration of the interaction.

An advantage of such an attachment lies in the possibility of positioning the deflecting shelf at an angle to the axis of the ball throwing machine, makes it possible, firstly, to increase the frictional force at the place of interaction between the ball and the shelf and hence to increase to a certain degree the extent of the ball spin and, secondly, to shorten the length of the sliding of the ball over the shelf and thereby somewhat to diminish the abrasive wear of balls.

Inasmuch, as the ball sliding friction in this attachment is still considerable, the abrasive wear of balls remains as well considerable while their velocity drops significantly. It should also be noted that the above-described attachment calls for a frequent manual adjustment and therefore is unsuitable for use in an automated training system, such as in tennis robots, where changing the intensity of the spin and the position of the ball rotation axis in the space should be provided in the course of operation of the ball throwing machine, in particular, after every hit.

SUMMARY OF THE INVENTION

The principal object of the present invention is to provide an orienting attachment to a ball throwing machine, wherein the friction in spinning a ball is reduced and hence the loss of its energy is lowered, and also the abrasive wear of balls is reduced.

A not less important object of the invention is to provide an orienting attachment which can be used in tennis robots.

Another object of the invention is to provide an orienting attachment which makes it possible to vary the angle of inclination of the ball rotation axis in the course of operation of a ball throwing machine (without stopping the latter).

The other objects of the invention include the provision of an orienting attachment which offers extensive functional capabilities, is simple in construction and convenient in service.

The above-mentioned and other objects of the present invention are attained by an orienting attachment to a ball throwing machine comprising a coupling unit for fastening the attachment to the ball throwing machine and a ball deflector connected with the unit, which according to the invention, the coupling unit has the form of a stationary sleeve fixedly attached to the ball throwing machine and a movable sleeve mounted for rotation onto the stationary sleeve, and the ball deflector is a rotatable frame with two rollers, made in the form of two parallel T-shaped levers each having a supporting leg and a head, the levers being hinged by the legs to the movable sleeve, and transverse spindles which couple the heads of said levers with each other and carry said rollers, the attachment also having stops secured to the movable sleeve and restricting the rotation of the frame up to its setting to one of two extreme positions and at least one retainer to hold the frame in one of the extreme positions, connected with the movable sleeve and with the leg of one of said levers.

With such a construction of the orienting attachment, the ball is spun by revolving it around one of the frame rollers substantially without any slip, which considerably reduces both the energy loss and the abrasive wear of balls while insignificantly slowing down the speed of an ejected ball. Moreover, the rotatability of the movable sleeve with respect to the stationary one allows the angle of inclination of the roller axes to the horizontal to be varied as desired and thereby the orientation of the axis of rotation of a flying ball in the space to be varied correspondingly.

The retainer to hold the frame in one of the two extreme positions in the proposed attachment may take various forms.

A modification of the attachment is in particular possible wherein the retainer comprises a flat spring whose one end is connected to the T-shaped lever, a cable connected to the other end of said spring and serving to control the latter, a bracket secured to said movable sleeve and having a hole for the passage of the cable, and a helical compression spring put onto the cable and thrusting by its one end against said bracket and by its other end against the flat spring.

Such a construction of the retainer makes it possible to use the proposed attachment in program-controlled tennis robots by moving the cable according to a preset program and thereby appropriately varying the position of the flat spring and of the frame with the rollers, coupled with the spring.

The retainer may also take the form of a helical tension spring attached by its one end to the T-shaped lever and by the other end to said movable sleeve so that the ends of the spring are disposed at different sides of the lever rotation axis and the line connecting the centres of the fastening of the lever and of the spring to the movable sleeve is parallel to the axis of the latter.

With such a construction of the retainer, after every ejection of a ball the frame shifts to a new stable position, owing to which the orienting attachment can function in an automatic mode of an alternate throwing of balls to the left-to the right or upwards-downwards without using an external programming device.

Such a modification of the attachment is expedient, wherein at least the surface layer of the rolls is made of an antifriction material. This still more reduces the friction of the ball against the surface of the roller substantially without decreasing the intensity of its spinning and reduces the abrasive wear of balls.

A modification of the orienting attachment is also advisable, wherein the frame stops are adjustable for changing the distance therebetween. This makes it possible to vary the maximum frame rotation angle and thereby the ball throwing angle.

BRIEF DESCRIPTION OF THE DRAWINGS

The exact nature of the present invention will become more clear from the following description of particular embodiments thereof with reference to the accompanying drawings, in which:

in FIG. 9 the ball is shown in the flight in a side view, when the axes of the frame rollers are parallel to a horizontal plane and;

in FIG. 10 the ball is shown in the flight in the top view, when the axes of the rollers are disposed in vertical planes.

DESCRIPTION OF THE PREFERRED EMBODIMENTS

Figure 1:
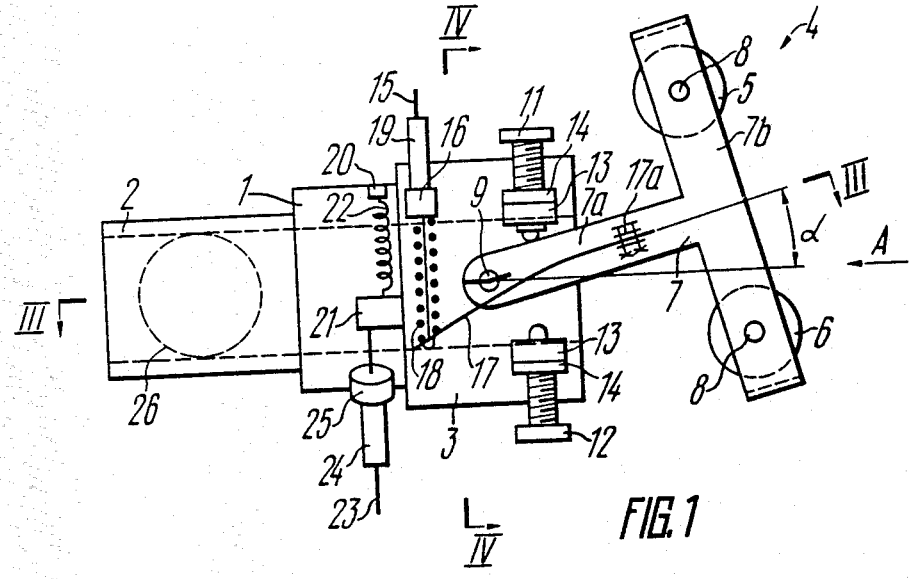
FIG. 1 is a side elevation of the proposed orienting attachment to a ball throwing machine.

The proposed orienting attachment to a ball throwing machine comprises a coupling unit to be secured to the ball throwing machine, the unit having the form of a stationary sleeve 1 (FIG. 1) fixedly connected to a barrel 2 of the machine and a movable sleeve 3 put for rotation onto the stationary sleeve 1. The attachment also comprises a ball deflector, which is a rotatable frame 4 with two rollers 5 and 6.

The frame 4 is composed of two levers 7 (see also FIGS. 2 and 3) and transverse spindles 8 which interconnect the levers. Each lever 7 is of a T-shaped configuration and comprises a supporting leg *7a* and a head *7b*. The lever 7 is by its legs *7a* hingedly connected with the rotatable sleeve 3 through pins 9, and the spindles 8 interconnecting the heads *7b* of the levers 7 carry said rollers 5 and 6. The rollers 5, 6 are fully or partly (in the surface layer) made of an antifriction material, such as capron or fluoroplastic.

Figure 2:
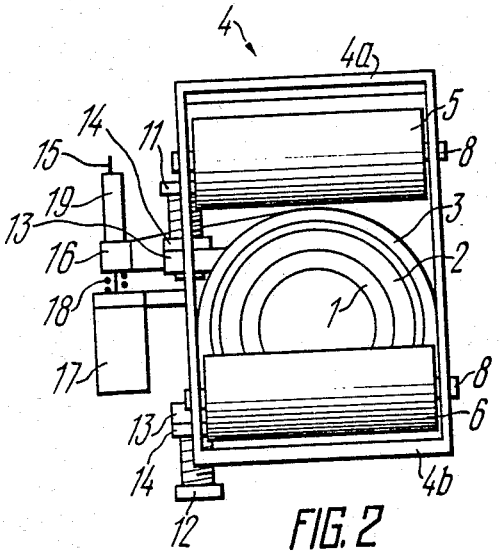
FIG. 2 is a view of the proposed attachment, looking in the direction of the arrow A in FIG. 1.
Figure 3:
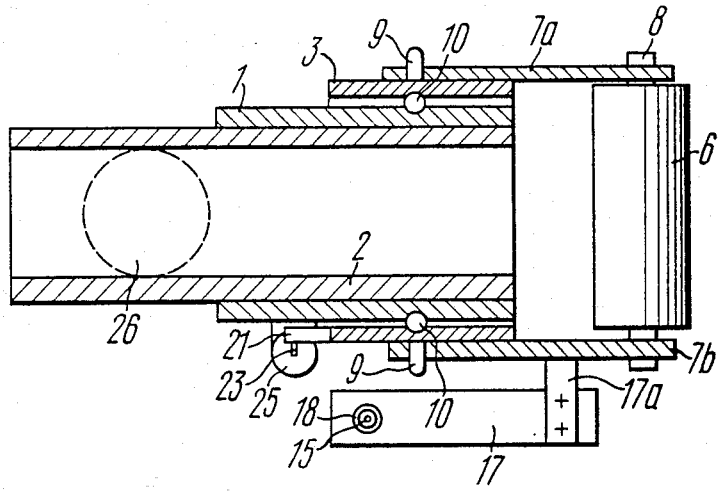
FIG. 3 is a sectional view taken along the line III—III in FIG. 1 for a modification wherein the retainer comprises a flat spring.

To enhance the stiffness of the frame 4, the T-shaped levers 7 are additionally interconnected by links *4a* and *4b* (FIG. 2). To facilitate rotation of the movable sleeve 3 with respect to the stationary sleeve 1, rolling bearings 10, in particular, ball ones (FIG. 3) are mounted therebetween.

Figure 4:
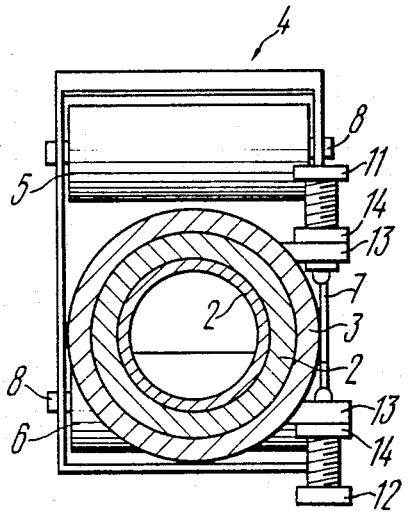
FIG. 4 is a sectional view taken along the line IV—IV in FIG. 1.

The proposed attachment (see FIG. 1) includes also stops 11 and 12, installed in posts 13 secured to the movable sleeve 3, as is best seen in FIG. 4. The stops 11 and 12 restrict the frame rotation around the pins 9 up to the setting of the frame to one of two extreme positions (FIG. 1 shows the frame 4 in the extreme upper position). In a particular case, the stops 11 and 12 are adjustable (for which purpose a thread is cut on them as well as in the posts 13) and provided with lock nuts 14, which makes it possible to vary the spacing of the stops 11 and 12 and thereby to control the maximum angle $\alpha$ of rotation of the frame 4.

Figure 5:
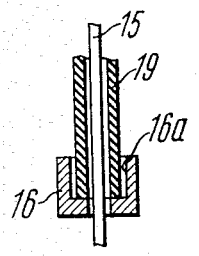
FIG. 5 is an enlarged view of the fragment B in FIG. 1.

To hold the frame 4 in one of the extreme positions, the attachment has either one retainer of two (one at the side of each T-shaped lever 7) retainers. FIG. 1 shows the modification with a single retainer, which in particular comprises a cable 15 mounted in a bracket 16 secured to the movable sleeve 3, a flat spring 17 whose one end is connected through a post *17a* (FIG. 3) with the leg *7a* of the lever 7 and whose other end is connected to the cable 15 (FIG. 1), and a helical compression spring 18 put onto the cable 15 and thrusting by its one end against the bracket 16 and by its other end against the flat spring 17 (in FIG. 1 the spring 18 is schematically shown as cut lengthwise for a better vizualization of the arrangement of the cable 15). The cable 15 is enclosed in a flexible sheath 19, and the bracket 16 has a stepped hole *16a* (FIG. 5) for mounting of the sheath 19 and passage of the cable 15.

To provide a controlled rotation of the movable sleeve 3, carrying the frame 4 with the rollers 5, 6, with respect to the stationary sleeve 1, the proposed orienting attachment comprises a rotation device including posts 20 and 21 disposed respectively on the stationary sleeve 1 and on the movable sleeve 3, a tension spring 22 connected with the posts, and a cable 23 secured to the post 21 and essentially similar to the cable 15. The cable 23 as well has a flexible sheath 24 installed in the same manner in a bracket 25 secured to the stationary sleeve 1.

The cables 15 and 23 allow the proposed orienting attachment to be connected to an external programming device (not shown), such as of a tennis robot, and thereby to control the ball spinning parameters (the speed and direction of ball rotation as well as the orientation of the ball rotation axis in the space). Using the cable 15, the frame 4 can be shifted to the required extreme position to bring either the roller 5 or the roller 6 into the interaction with a moving ball 26 (shown by a dotted line) to impart respectively a bottom or a top spin to the ball 26, while the cable 23 makes it possible to rotate the movable sleeve 3 jointly with the frame 4 relative to the axis of the ball throwing machine barrel 2 and thereby to vary the orientation of the axis of rotation of the ball 26 in space.

The springs 18 and 22 provide for a tautness of the cables 15 and 23 and thereby upgrade the accuracy of rotation of the frame 4 in various planes.

Figure 6:
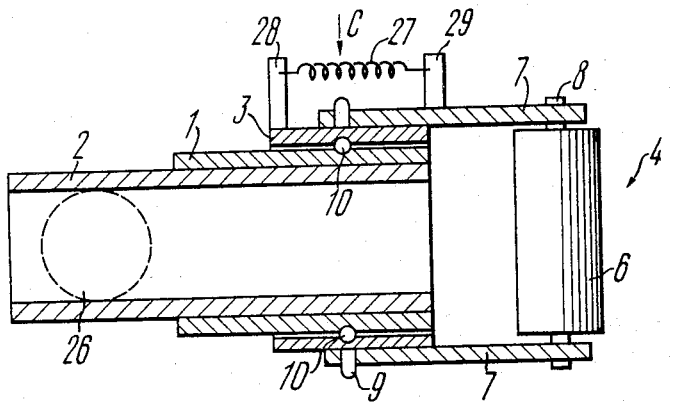
FIG. 6 is the same as FIG. 3, but for a modification wherein the retainer comprises a helical tension spring which provides for two stable positions of the frame with the rolls.
Figure 7:
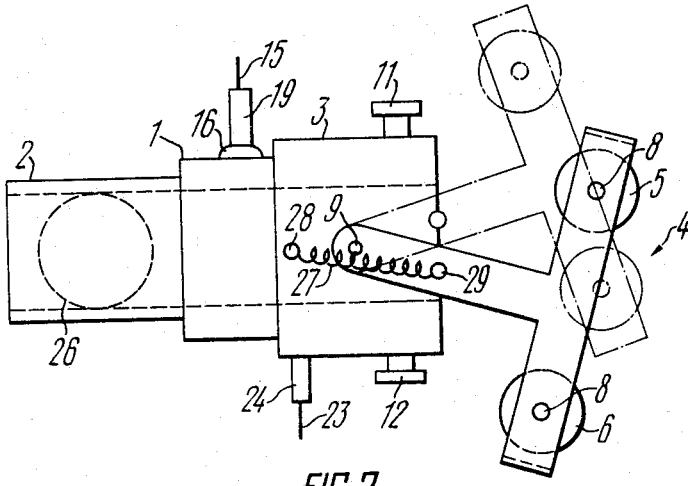
FIG. 7 is a view taken in the direction of the arrow C in FIG. 6, the frame with the rolls being shown in the lowermost position.

When an automatic shift of the frame 4 to a new stable position after every ejection of the ball 4 is needed, it is advisable to employ the modification of the orienting attachment, shown in FIGS. 6 and 7. In this modification the retainer to hold the frame in one of the extreme positions has the form of a helical spring 27 mounted on posts 28 and 29, the post 28 being secured to the movable sleeve 3, and the post 29, to the leg 7*a* of one of the T-shaped levers 7. The disposition of the post 28 is selected so that a conventional straight line connecting the centers of the fastenings of the lever 7 and spring 27 to the movable sleeve 3 (in FIG. 7 this line connects the centers of elements designated 9 and 28) in parallel to the axis of the latter. With such a fastening of the spring 27, the frame 4 can readily pass from the lower stable position to the upper one (shown by a dotted line) and vice versa when the emerging ball 26 acts upon the corresponding roller 5 or 6.

The above-described orienting attachment functions as follows. The attachment is installed on the ball throwing machine barrel 2 and the frame 4 with the rollers 5 and 6 is set to the required position, such as to the one shown in FIG. 1 where the lower roller 6 is positioned in the path of the ball 26.

Figure 8:
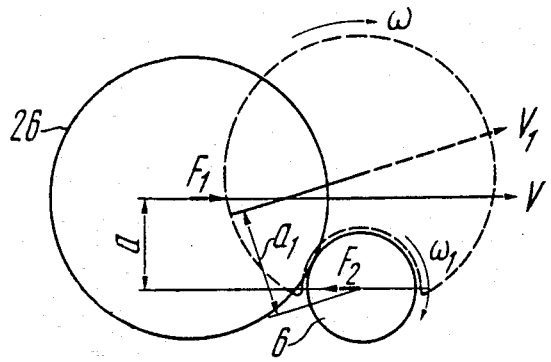
FIG. 8 is a diagram showing the interaction of a ball with one of the frame rollers.

When being thrown, the ball 26 moving along the barrel 2 at a velocity v runs against the roller 6 and gets deformed in the interaction with the latter, as shown schematically in FIG. 8.

At this moment, the ball 26 will be acted upon by the inertial force $F_1$ applied to the centre of gravity of the ball and by the component $F_2$ of the ball reaction force, parallel to the force $F_1$, but directed oppositely and applied to the axis of rotation of the roller 6. The moment of the forces $F_1$ and $F_2$ sets the ball into rotation around its axis at an angular velocity $\omega$, and the ball flight velocity is changed in the magnitude and direction and assumes a new value $v_1$. The roller 6 rotates jointly with the ball around the roller axis in the direction of the arrow $\omega_1$, this mutual rotation of the ball 26 and the roller 6 proceeds substantially without a slip. In FIG. 8, "a" designates the distance from the centre of gravity of the ball 26 to the axis of the roller 6 before their interaction, and "$a_1$, the same at the end of their interaction. The angular velocity $\omega$ of rotation of the ball 26 will in this case be close to the value $\omega = v_1/a_1$. Inasmuch, as the value of "$a_1$", preset by the angle of rotation of the frame 4 (FIG. 1) around the axis of the pins 9 by the preselected resilience of the spring 17, can be relatively small (for example, for a 0.066-m-diameter tennis ball the "$a_1$" value equals 0.015 m), the possiblity is provided to throw a ball with an intense spin which is needed, e.g., to simulate play situations with superspin hits.

It should be emphasized that since the ball-roller interaction proceeds with substantially no slip, the wear of balls and the loss of kinetic energy are drastically reduced. This allows higher ball ejection velocities to be attained.

Figure 9:
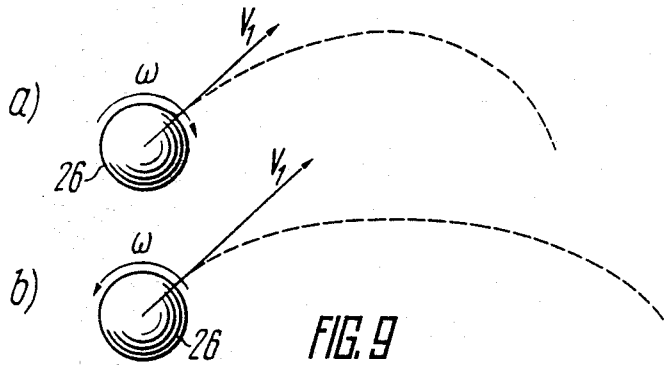
FIGS. 9 and 10 are diagrams illustrating the principal types of ball spinning, obtained with the aid of the proposed orienting attachment (the arrows show the directions of travel and spinning of the ball; the dotted lines show the path of the ball travel)
Figure 10:
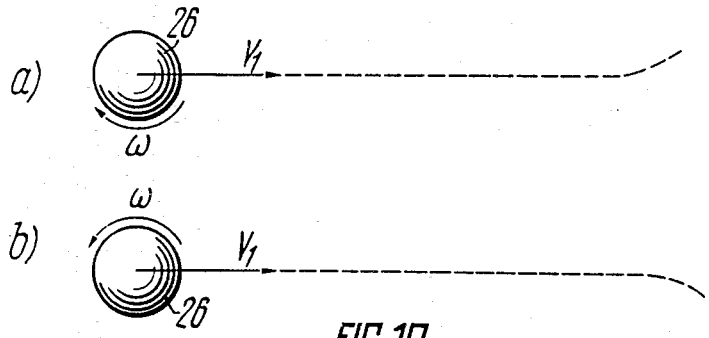

FIGS. 9 and 10 illustrate the principal ball spin types attained with the use of the above-described attachment. FIG. 9*a* shows a top spin of a ball, attained when the lower roller 6 comes into the interaction with the ball 26 (the frame 4 is shown in this position in FIG. 1). To produce a bottom spin (FIG. 9*b*), the cable 15 (FIG. 1) is pulled upwards to compress the spring 18 and to rotate the frame 4 until the lever 7 comes into contact with the lower stop 12; this will bring the upper roller 5 into contact with the ball 26.

A right-hand side spin of the ball 26 (FIG. 10*a*) is produced by rotating the movable sleeve 3 around the stationary sleeve with the aid of the cable 23 through 90° with respect to the position shown in FIG. 1; this will bring the right-hand (with respect to the ball flight direction) roller into the interaction with the ball 26. The interaction of the left-hand (with respect to the same direction) roller with the ball 26 produces a left-hand side spin of the ball 26 (FIG. 10*b*).

All the remaining intermediate positions of the frame 4 (FIG. 1), except the two above-mentioned positions (corresponding to FIGS. 9 and 10), i.e. when the movable sleeve 3 with the frame 4 has been rotated through an angle more or less than 90° with respect to the position shown in FIG. 1, produce combined types of the spin of the ball 26, such as a combination of a top spin with a right-hand side spin, of a bottom spin with a right- or left-hand side spin, etc. The ball spin parameters are varied according to a preset program by the programming device through the cables 15 and 23.

For the ball throwing machine to operate in the mode or an automatic ball throwing to the left- to the right or upwards-downwards without the use of external programming devices, the flat spring 17 (FIG. 1) is removed and the orienting attachment is modified as shown in FIGS. 6 and 7, the helical spring 27 being secured to the posts 28, 29. In this case the frame 4 is after every interaction of one of the rollers 5, 6 with the next ball 26 due is thrown over to a new stable position, and the ball 26 is deflected to the other side. This alternates the directions of ball ejections while the ball scatter angle is adjusted by the stops 11 and 12.

From the above description it will be apparent that the proposed orienting attachment offers broad functional capabilities and makes it possible to simulate combinations of hits with various degrees and directions of the ball spinning, which significantly enhances the effectiveness of sportsmen training.

While particular embodiments of the invention have been shown and described, various modifications thereof will be apparent to those skilled in the art, and therefore it is not intended that the invention be limited to the disclosed embodiments or to the details thereof, and departures may be made therefrom within the spirit and scope of the invention as defined in the appended claims.

What is claimed is:

1. An orienting attachment for a ball throwing machine, comprising:

(a) a coupling unit for securing the attachment to said ball throwing machine, including (i) a stationary sleeve rigidly attached to the barrel of a ball throwing machine;

(ii) a rotatable sleeve coaxially mounted on said stationary sleeve for rotation about the axis of said stationary sleeve;

(b) a ball deflector mounted on said movable sleeve and which may be rotated between two extreme positions, including (i) two rollers and (ii) a rotatable frame comprising two parallel T-shaped levers, each having a thrust leg and a head hingedly connected by said legs with said movable sleeve, and transverse spindles interconnecting said heads of said T-shaped levers and carrying said rollers mounted thereon so that they may be freely rotated, (c) stops secured to said movable sleeve for abutting against and restricting the rotation of said rotatable frame when said frame is set to one of two extreme positions, and (d) at least one retainer on said movable sleeve for holding said frame in one of the extreme positions, connected with said movable sleeve and with the leg of one of said levers.

2. An attachment as claimed in claim 1, wherein said retainer is essentially a flat spring one end of which is connected to said T-shaped lever, a cable connected to the other end of said spring and serving to control the latter, a bracket secured to said movable sleeve and having a hole for passage of said cable, and also a helical compression spring fitted onto said cable and thrusting with one end against said bracket, and with the other end against said flat spring.

3. An attachment as claimed in claim 2, wherein said stops of said frame are made adjustable for varying the spacing therebetween.

4. An attachment as claimed in claim 1, wherein at least the surface layer of said rollers is made of an anti-friction material.

5. An attachment as claimed in claim 1, wherein said stops of said frame are made adjustable for varying the spacing therebetween.

* * * * *